US008434755B2

(12) United States Patent
Imai

(10) Patent No.: US 8,434,755 B2
(45) Date of Patent: May 7, 2013

(54) SHEET GUIDE, SHEET CARRYING DEVICE AND IMAGE FORMING DEVICE THEREWITH

(75) Inventor: Manabu Imai, Tokyo (JP)

(73) Assignee: Oki Data Corporation, Tokyo (JP)

( * ) Notice: Subject to any disclaimer, the term of this patent is extended or adjusted under 35 U.S.C. 154(b) by 52 days.

(21) Appl. No.: 12/943,437

(22) Filed: Nov. 10, 2010

(65) Prior Publication Data

US 2011/0115149 A1 May 19, 2011

(30) Foreign Application Priority Data

Nov. 13, 2009 (JP) ..... 2009-259864

(51) Int. Cl.
*B65H 3/44* (2006.01)

(52) U.S. Cl.
USPC ..... 271/9.13; 271/225; 271/245

(58) Field of Classification Search ..... 271/9.01, 271/9.13, 225, 25, 264, 245
See application file for complete search history.

(56) References Cited

U.S. PATENT DOCUMENTS

| | | | | |
|---|---|---|---|---|
| 6,533,271 | B1 * | 3/2003 | Zimmermann | 271/303 |
| 6,805,347 | B2 * | 10/2004 | Kuramoto | 271/242 |
| 2007/0013120 | A1 * | 1/2007 | Lo et al. | 271/3.14 |

FOREIGN PATENT DOCUMENTS

| | | | |
|---|---|---|---|
| JP | 04059537 | A * | 2/1992 |
| JP | A-H04-298452 | | 10/1992 |
| JP | A-2007-70033 | | 3/2007 |
| JP | A-2008-050142 | | 3/2008 |
| JP | A-2009-91142 | | 4/2009 |

* cited by examiner

*Primary Examiner* — Michael McCullough
(74) *Attorney, Agent, or Firm* — Posz Law Group, PLC

(57) ABSTRACT

A sheet guide is rotationally supported by a shaft member to rotate freely on the shaft member. The sheet guide includes a support part that supports the sheet guide on the shaft member, a guide part that contacts sheets and guides sheets in a predetermined direction, and a weight, which has a predetermined weight, is arranged on an opposite side of the support part from the guide part, wherein the weight causes the guide part to rotate to a predetermined position when an external force applied to the guide part is released.

20 Claims, 9 Drawing Sheets

Relavant Art

SHEET GUIDE, SHEET CARRYING DEVICE AND IMAGE FORMING DEVICE THEREWITH

CROSS REFERENCE TO RELATED APPLICATION

The present application is related to, claims priority from and incorporates by reference Japanese Patent Application No. 2009-259864, filed on Nov. 13, 2009.

TECHNICAL FIELD

The present invention relates to a sheet guide and a sheet carrying device that guide sheets to be carried, and an image forming device including the sheet carrying device.

BACKGROUND

In a conventional image forming device, a plurality of image formation units, which form toner images to be transferred onto a sheet, are positioned along a sheet carrying direction. The image formation units and transfer rollers are positioned to face each other across a carrying belt, which is positioned horizontally. A sheet stored with its image formation surface down in a sheet cassette positioned below the carrying belt is fed from the sheet cassette diagonally upwardly by sheet feeding rollers and is guided by a guide member. A front end of the sheet is nipped upwardly by a first carrying roller pair and directed to a second carrying roller pair by guiding the sheet in a turning carrying path that turns the sheet carrying direction by approximately 90 degrees. The sheet with its image forming surface facing up is nipped by the second carrying roller pair and carried onto the horizontal carrying belt. Toner images respectively formed by the image forming units are transferred onto the image formation surface of the sheet. (See JP Laid-Open Patent Application Publication No. 2008-50142, paragraphs 0015-0020, 0024-0027, and FIG. 2).

However, in such a device, the front end of the sheet is nipped upwardly by the first carrying roller pair and directed to the second carrying roller pair by guiding the sheet in the turning carrying path, which turns the sheet carrying direction by approximately 90 degrees. As shown in FIG. 14, a step is formed between a nip of the first carrying roller pair 101 and an upstream end of a carrying guide 103, which is located on an outer side of a curve of the turning carrying path 102. Therefore, after the front end of a sheet P that is nipped by the first carrying roller pair 101 and that is carried to the second carrying roller pair 104 as directed by the turning carrying path 102 is nipped by the second carrying roller pair 104, and at the moment when a rear end (or trailing end) of the sheet P is released from being nipped by the first carrying roller pair 101, a restorative force (in the direction of arrow A shown in FIG. 14) generated by the elasticity of the sheet tries to restore the original shape of the sheet. At that time, there is a problem that a hitting sound is caused when the rear end of the sheet P swiftly moves in the direction of the carrying guide 103 of the turning carrying path 102 due to the restorative force and strikes the carrying guide 103 at the time of sheet supply.

The present invention is created to suppress the above-discussed problem and has an object to reduce the hitting sound by the rear end of the sheet at the time of sheet supply by suppressing the flapping motion of the rear end of the sheet due to the restorative force of the sheet.

SUMMARY

In order to suppress the above problems, a sheet guide of the present invention is rotationally supported by a shaft member to rotate freely on the shaft member, wherein the sheet guide includes a support part that supports the sheet guide on the shaft member, a guide part that contacts sheets and guides sheets in a predetermined direction, and a weight, which has a predetermined weight, is arranged on an opposite side of the support part from the guide part, wherein the weight causes the guide part to rotate to a predetermined position when an external force applied to the guide part is released.

Further, the sheet guide of the present invention includes a carrying roller pair that carries sheets by rotation, a sheet guide that is freely rotational and that is provided on one roller of the carrying roller pair. The sheet guide includes a guide part that contacts the sheets and guides the sheets in a predetermined direction, and a guide surface that extends in a tangential direction of an outer surface of the one of the rollers when viewed in an axial direction of a rotational shaft of the one roller.

As a result, the present invention has an effect to reduce a hitting sound caused by the rear end of the sheet at the time of sheet supply by suppressing, using a guide part of the sheet guide, the flapping motion by the rear end of the sheet due to the restorative force of the sheet generated when the sheet is released from being nipped by the carrying roller pair.

DETAILED DESCRIPTION OF THE EMBODIMENTS

Embodiments of a sheet guide, a sheet carrying device and an image forming device according to the present invention are explained below with reference to the drawings.

(First Embodiment)

Figure 1:
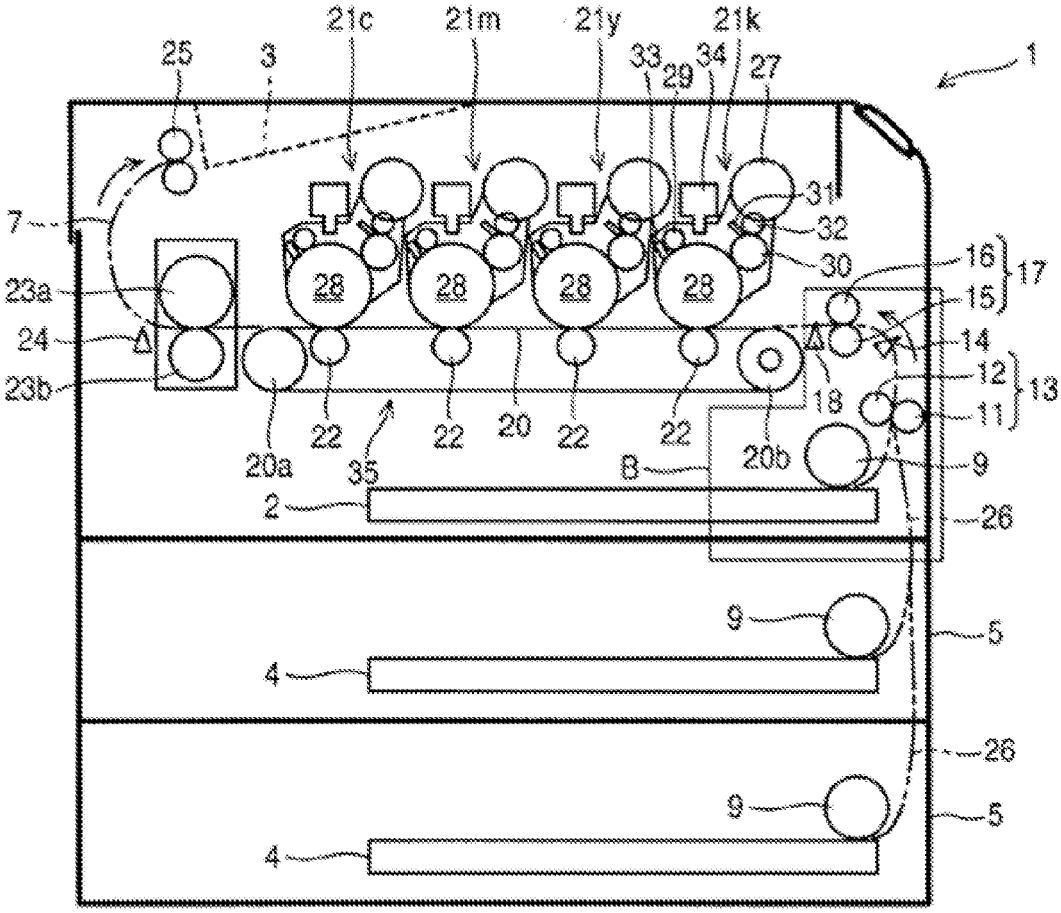
FIG. 1 is an explanatory diagram showing a schematic configuration of a printer according to the first embodiment.

In FIG. 1, reference numeral 1 indicates an electrographic printer as an image forming device.

Figure 2:
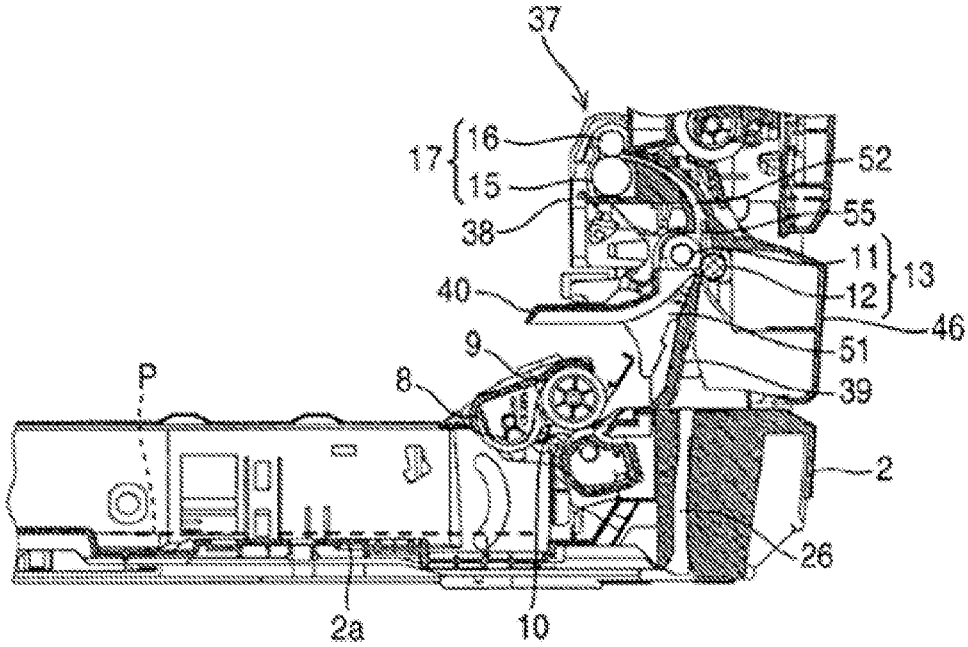
FIG. 2 is a detailed view of a part B in FIG. 1

In the printer 1, a sheet cassette 2, in which sheets P, or print media, are stored on a placement plate 2*a* with their image formation surfaces down, is removably mounted (see FIG. 2). On the upper surface of the printer 1, a stacker 3 is provided to stack the sheets P after printing. A plurality of trays 5 that store cassettes 4 having the same configuration as the sheet cassette 2 for supplying additional sheets P in a large volume is removably mounted as additional sheet supply devices below the sheet cassette 2.

In the present application, "upper and lower" and "above and below" are basically defined in the view of FIG. 1.

The sheet cassette 2 and stacker 3 are connected by an approximately S-shaped carrying path 7 indicated by a single-dotted line shown in FIG. 1. A pickup roller 8, a sheet supply roller 9 and a retard roller 10 that feed each sheet P from the sheet cassette 2 to the carrying path 7 are provided in a connection part between the carrying path 7 and the sheet cassette 2 (see FIG. 2). The sheets P that are separated into each sheet and fed by the sheet supply roller 9 and the retard roller 10 are carried to an endless carrying belt 20 positioned in a horizontal direction between a drive roller 20*a* and a driven roller 20*b* through a first carrying roller pair 13 formed by a first drive roller 11 and a first pressure application roller 12, an entrance sensor 14, a second carrying roller pair 17 formed by a second drive roller 15 and a second pressure application roller 16, and a writing sensor 18. Toner images are transferred onto the image formation surface of the sheet P as developer images by a plurality of image formation units 21 and transfer rollers 22 positioned to face each other across the flat sides of the carrying belt 20. The toner images are fixed on the sheet P by pressure and heat using a fuser unit 23 formed by a heat roller 23*a* having a heat body, such as a halogen lamp, therein and a backup roller 23*b*. The sheet P, on which the toner images have been fixed, is carried to an ejection roller 25 after passing the exit sensor 24 and is ejected on the stacker 3 with the image formation surface down.

In addition, the sheet cassette 4 of each tray 5 and the first carrying roller pair 13 (or nip rollers) are connected by an additional sheet carrying path indicated by a double-dot line shown in FIG. 1.

The plurality of image formation units 21 includes image formation units 21*k*, 21*y*, 21*m* and 21*c* arranged along the carrying direction of the sheet P (maybe referred to as a sheet carrying direction), which store toners, as developers, in the colors of K (black), Y (yellow), M (magenta) and C (cyan), respectively, in order from an upstream end of the sheet carrying path. The four image formation units 21 respectively include a photosensitive drum 28, a charge roller 29, a development roller 30, a development blade 31, a toner supply sponge roller 32, and a cleaning blade 33, which are positioned around the photosensitive drum 28. Above the photosensitive drum 28, a light emitting diode (LED) head 34 is positioned as an exposure device to face the photosensitive drum 28.

A transfer unit 35 is formed by the carrying belt 20 bridged between the above-discussed drive roller 20*a* and driven roller 20*b*, and a plurality of transfer rollers 22 positioned inside the transfer belt 20.

The sheet cassette 2 provided in the printer 1 of the present embodiment is positioned below the carrying belt 20. As shown in FIG. 2, the placement plate 2*a* and the retard roller 10 are attached to the sheet cassette 2.

Moreover, the pickup roller 8 and the sheet supply roller 9 are attached on the upper side (upper direction in FIG. 2) of the sheet cassette 2. A sheet carrying unit 37 is positioned above the sheet supply roller 9 and on the front side (a right side in FIG. 2) of the carrying belt 20. A later-discussed front cover 46 is attached on the front side of the sheet carrying unit 37.

Figure 3:
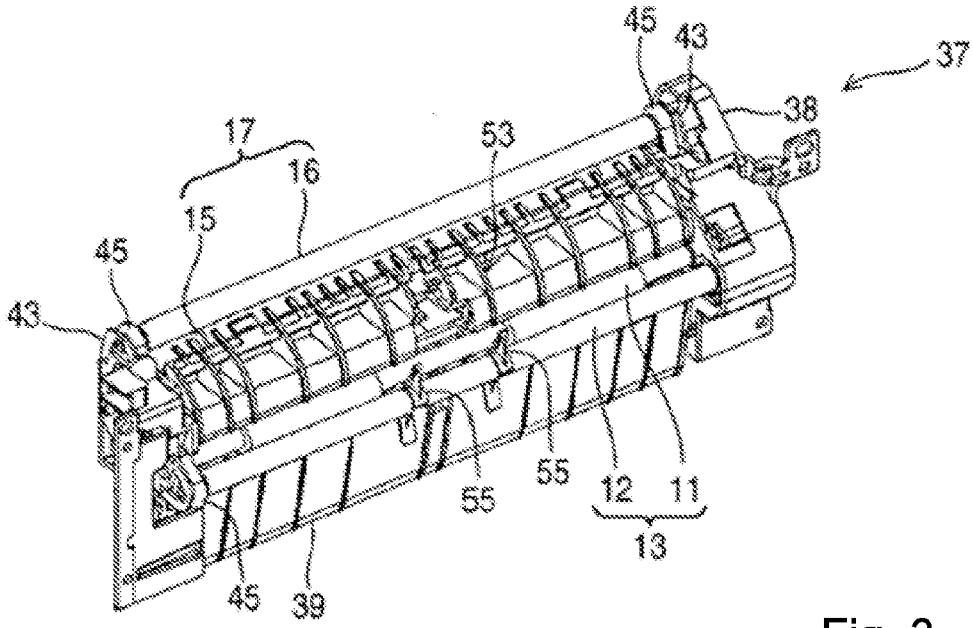
FIG. 3 is an explanatory diagram showing an exterior view of a sheet carrying unit according to the first embodiment.
Figure 4:
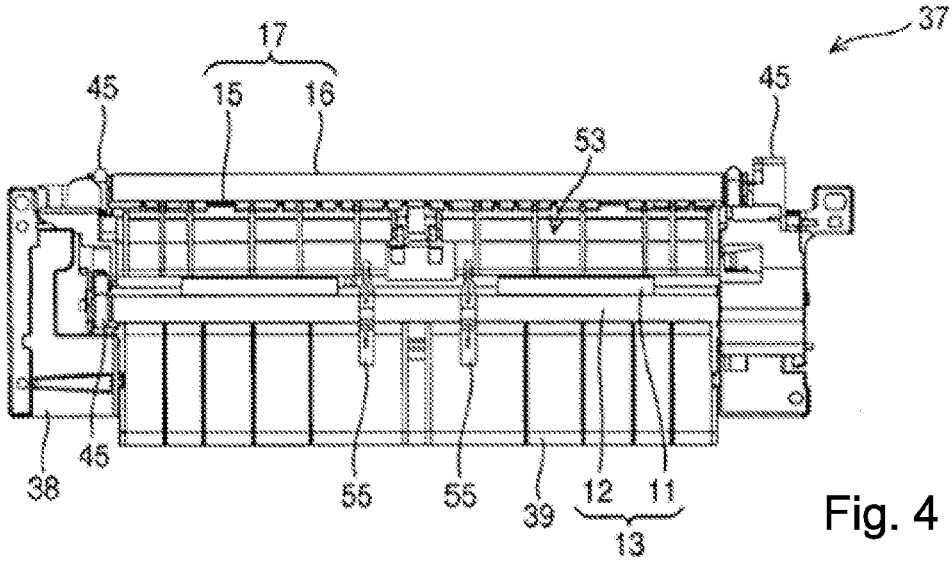
FIG. 4 is an explanatory diagram showing a front view of the sheet carrying unit according to the first embodiment.
Figure 5:
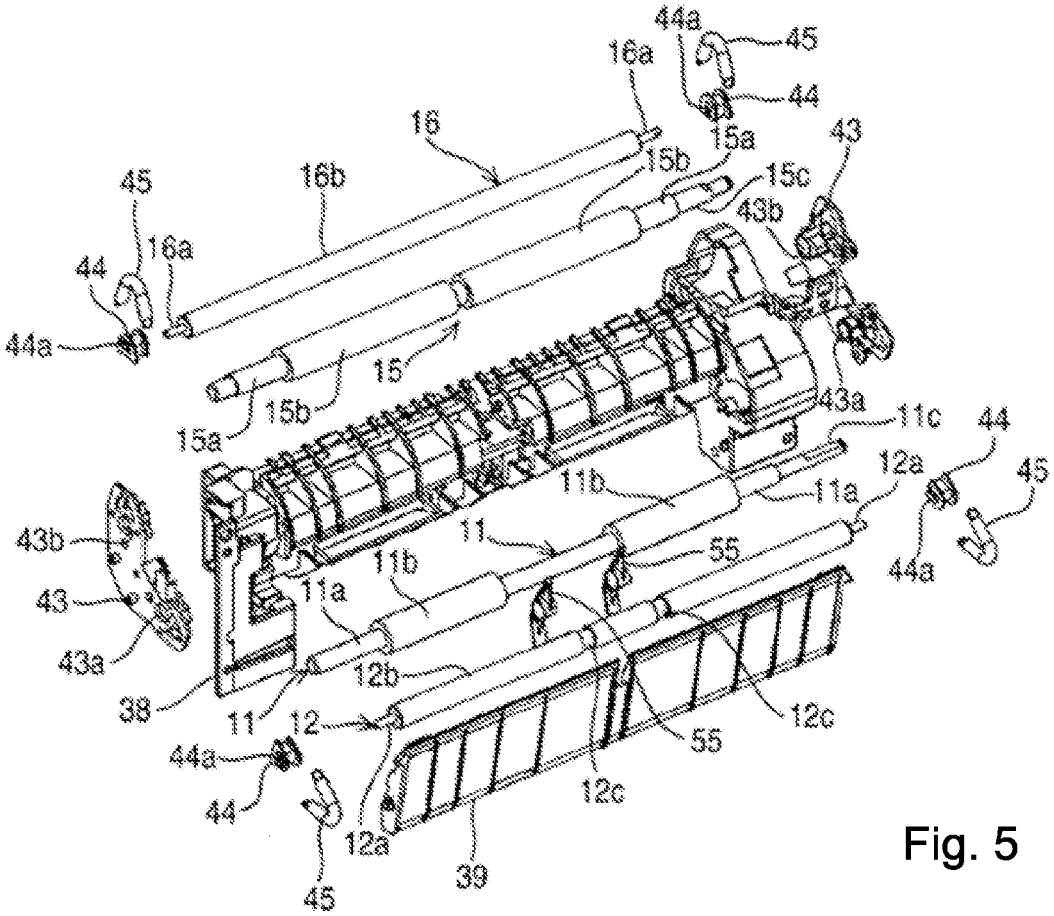
FIG. 5 is an explanatory diagram showing an exterior view of each part of the sheet carrying unit according to the first embodiment.

As shown in FIGS. 3-5, in the sheet carrying unit 37 according to the present embodiment, the first carrying roller pair 13 formed by the first drive roller 11 and the first pressure application roller 12 and the second carrying roller pair 17 formed by the second drive roller 15 and the second pressure application roller 16 are attached to a unit main body 38. A sheet carrying guide 39 is attached below the first carrying roller pair 13 on the front side of the unit main body 38, and a sheet carrying guide part 40 is formed at the unit main body 38 below the first drive roller 11.

As shown in FIG. 5, the first drive roller 11 is a stepped shaft member with shaft bearing engagement parts 11*a* formed on both sides thereof. Between the shaft bearing engagement parts 11*a*, carrying parts 11*b* formed by a friction member, such as a synthetic rubber, which forms an outer surface of the first drive roller 11, are provided symmetrically about the center of the first drive roller 11 in the axial direction. A drive part 11*c*, to which a drive gear engages, is formed on an end of one of the shaft bearing engagement part 11*a*.

The first pressure application roller 12 is a stepped shaft member formed by a metal material with shaft bearing engagement parts 12*a* formed on both sides thereof. A large diameter part between the shaft bearing engagement parts 12*a* functions as a pressure application part 12*b* that applies pressure against the carrying parts 11*b* of the first drive roller 11.

Further, two grooves 12*c* that engage with later-discussed sheet guides 55 are formed at a center part of the pressure application part 12*b* of the first pressure application roller 12, which corresponds to a space between the two carrying parts 11*b* of the first drive roller 11.

The second drive roller 15 is a stepped shaft member with shaft bearing engagement parts 15*a* on both sides thereof, which are similar to the first drive roller 11. Between the shaft bearing engagement parts 15*a*, carrying parts 15*b*, which form an outer surface of the second drive roller 15, are provided symmetrically about the center of the second drive roller 15 in the axial direction. A drive part 15*c*, with which a drive gear engages, is formed on an end of one of the shaft bearing engagement parts 15*a*.

Similar to the first pressure application roller 12, the second pressure application roller 16 is a stepped shaft member formed by a metal material with shaft bearing engagement parts 16*a* formed on both sides thereof. A large diameter part between the shaft bearing engagement parts 16*a* functions as a pressure application part 16*b* that applies pressure against the carrying parts 15*b* of the second drive roller 15.

In FIG. 5, reference numeral 43 indicates roller support members, which are attached to both sides of each roller of the unit main body 38 in the axial direction (see FIG. 3). Shaft bearing parts 43*a*, with which the shaft bearing engagements parts 11*a* of the first drive roller 11 engage, and shaft bearing parts 43*b*, with which the shaft bearing engagement parts 15*a* of the second drive roller 15 engage, are provided with the roller support members 43.

Figure 6:
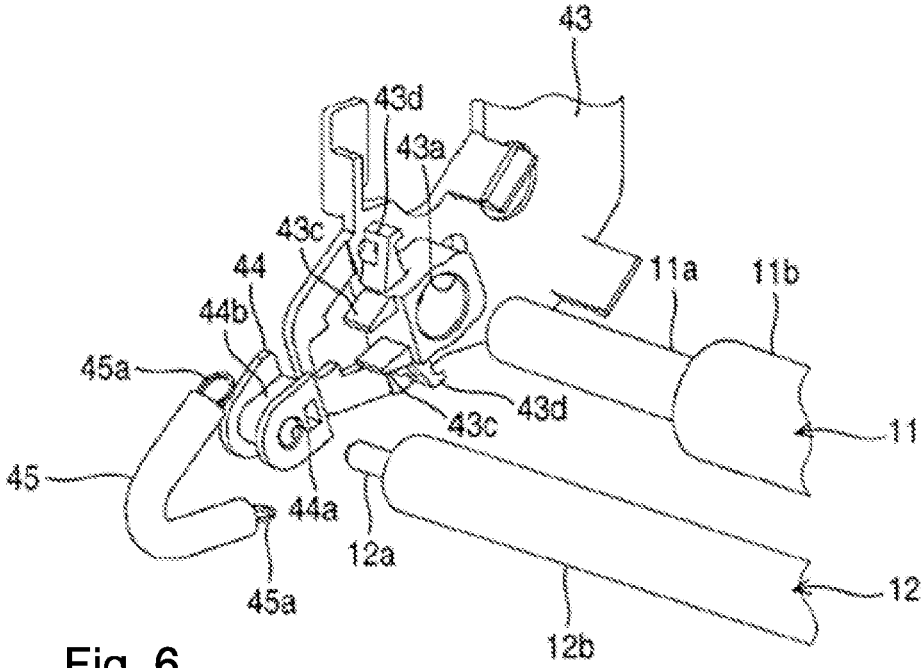
FIG. 6 is an explanatory diagram showing an attachment part of the first carrying roller pair according to the first embodiment.

Reference numeral 44 indicates a pressure application roller shaft bearing member. To the pressure application roller shaft bearing member 44, shaft bearing parts 44*a*, with which the shaft bearing engagement parts 12*a* of the first pressure application roller 12 or the shaft bearing engagement parts 16*a* of the second pressure application roller 16 engage, are provided. As shown in FIGS. 5 and 6, a slide groove 44*b* formed on an outer side of the shaft bearing part 44*a* in the radius direction is fitted to slide parts 43*c* provided near the shaft bearing parts 43*a* and 43*b*, respectively, of the roller support member 43. Hook parts 45*a* provided at both sides of a pressure application spring 45 turned on the slide groove 44*b* are hooked on spring hooks 43*d* provided at the roller support member 43 (see FIG. 3).

By a bias force of the pressure application spring 45, the pressure application part 12*b* of the first pressure application roller 12 and the pressure application part 16*b* of the second pressure application roller 16 are pressed against the carrying part 11*b* of the first drive roller 11 and the carrying part 15*b* of the second drive roller 15, respectively, thereby forming the first carrying roller pair 13 and the second carrying roller pair 17 that nip the sheet P between the respective pair of rollers. The location where a pair of rollers presses a sheet is referred to as a nip or a nipped part.

Figure 7:
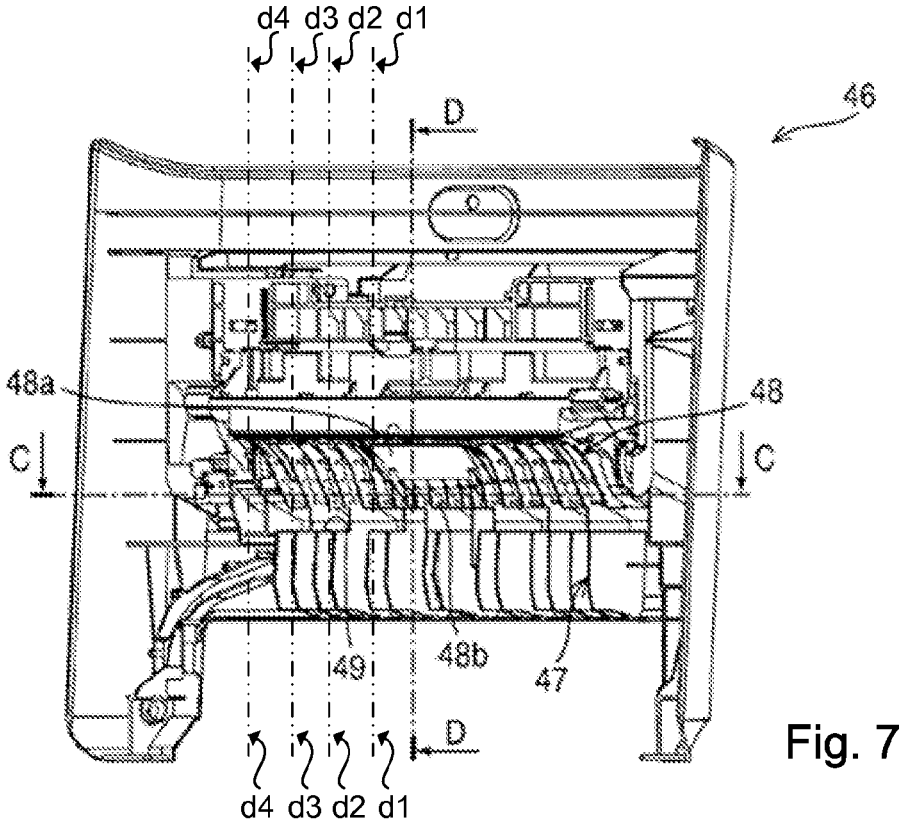
FIG. 7 is an explanatory diagram showing an exterior view of a front cover according to the first embodiment.
Figure 8:
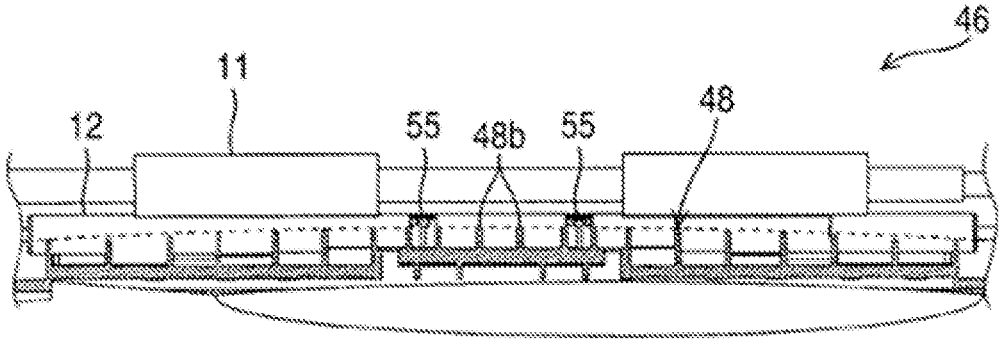
FIG. 8 is an explanatory diagram showing a cross-section along a cross-sectional line C-C in FIG. 7.

As shown in FIG. 7 and FIG. 8, which illustrates a cross-section along the line C-C in FIG. 7, on the front cover 46 of the present embodiment, a carrying guide 47 and a carrying guide 48, on which a plurality of sheet guide ribs are arranged in a direction orthogonal to the sheet carrying direction (which may be referred to as a width direction), are provided on the front side and a back side, which is opposite to the front side. The carrying guide 47 is positioned below the first pressure application roller 12 of the first carrying roller pair 13, and the carrying guide 48 is positioned on a downstream side of the first carrying roller pair 13. Between the carrying guide 47 and the carrying guide 48, an accommodation space 49 for the first pressure application roller 12 is provided in which a part of the sheet guide rib of the carrying guide 47 is cut out to position the first pressure application roller 12 (see FIG. 9).

Figure 9:
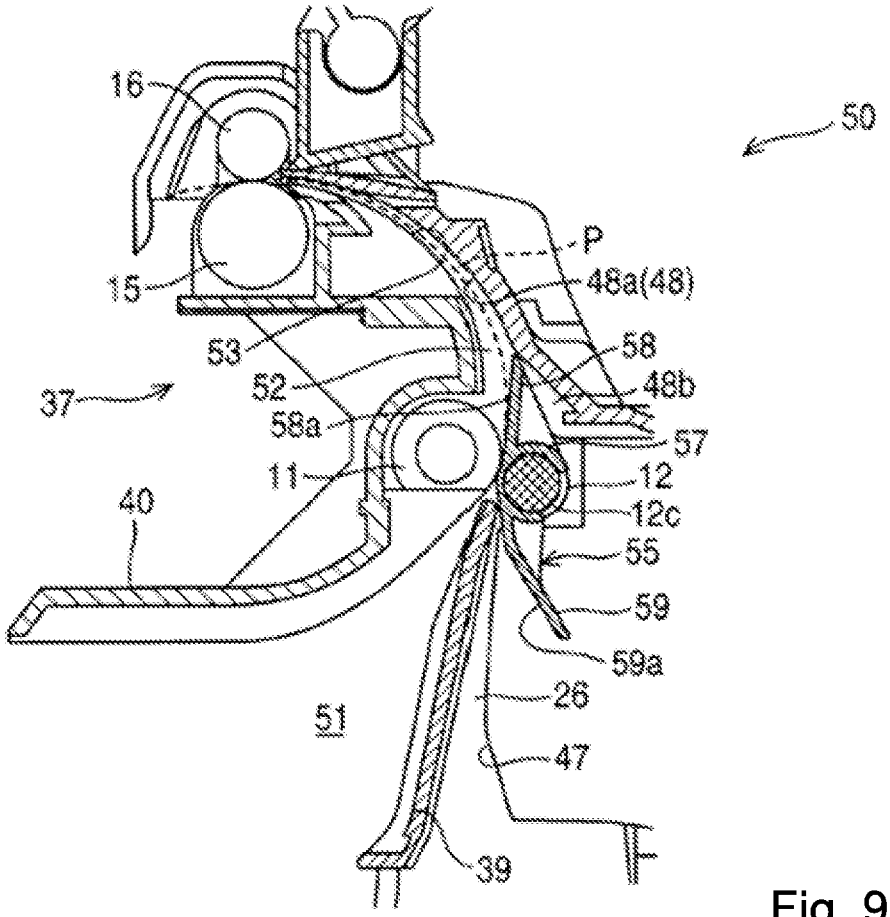
FIG. 9 is an explanatory diagram showing a configuration of a sheet carrying device according to the first embodiment.

The carrying guides 47 and 48 shown in FIG. 9 are indicated by the cross-section along the line D-D in FIG. 7.

A sheet guide surface 48*a* is formed at a center part (in the width direction) of the carrying guide 48 on a downstream side in the sheet carrying direction. A positioning part 48*b* formed by a plurality of ribs is formed above the accommodation space 49 between the sheet guide surface 48*a* and the first pressure application roller 12, with the height of the positioning part 48*b* being lower than the height of the ribs of the carrying guide 47. As shown in FIG. 8, the curved sheet guide ribs arranged symmetrically about the center in the width direction are positioned such that the heights of the sheet guide ribs are gradually reduced towards the ends in the width direction of the front cover 46 from its center.

Figure 15:
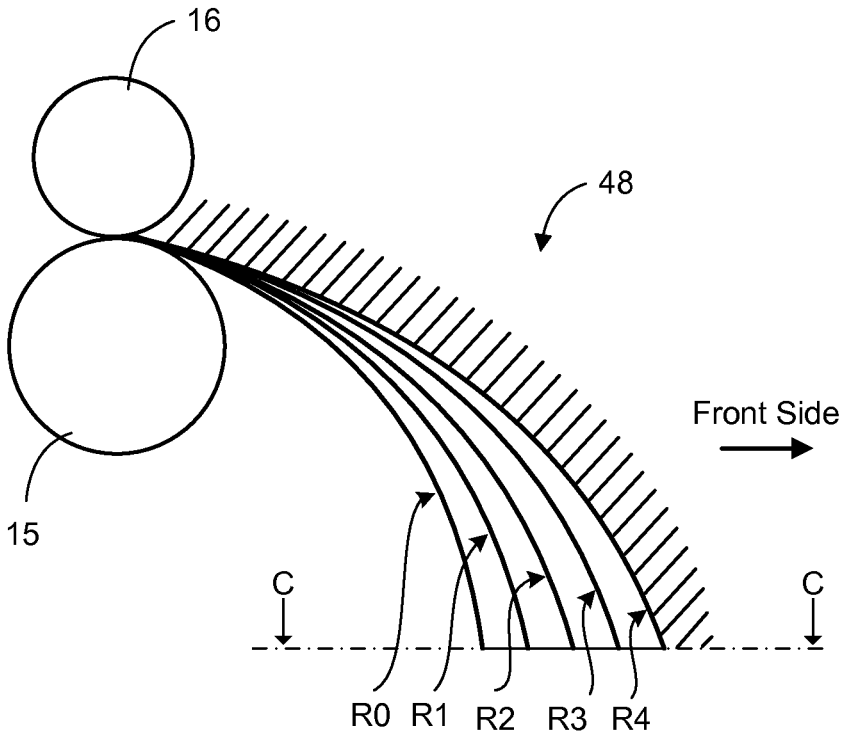
FIG. 15 is an explanatory diagram schematically showing cross-sectional views of a carrying guide along cross-sectional lines D and d1 to d4 in FIG. 7.

FIG. 15 is a view like FIG. 9, schematically illustrating different sizes of the ribs R0-R4 of the positioning part 48*b*. Rib R0 corresponds to cross sectional line D in FIG. 7, which corresponds to the center of the carrying guide 48 in the lateral direction. Ribs R1 to R4 respectively correspond to lines d1 to d4, and rib R4 is located at the far side of the carrying guide 48. As shown in FIG. 15, at the nip of the second driver roller 15 and the second pressure application roller 16, the outer sheet-guiding surfaces of all of the ribs R0-R5 are located at the same position. In other words, all ribs R0-R4 have the same height at the nip of the second driver roller 15 and the second pressure application roller 16. On the other hand, at the line C-C (in which is located at the bottom of FIG. 15), rib R0 has the smallest radius of curvature, and rib R4 has the largest radius of curvature. Therefore, the tips of the ribs at a given cross section in the lateral direction form a curve such that the curve becomes more gradual toward the lateral ends. The curve of the ribs R0-R4 may not be circular and may be formed by multiple curves having various radius of curvature. Thus, rib R0 has the greatest height, and rib R4 has the smallest height at the location of the line C-C. In the middle section, ribs R1-R4 have heights that increase at locations farther from the center section to the sides in the lateral direction. Because of the rib structure, the guide surface of the carrying guide 48 is contoured (or curved) from the center section to the sides in the lateral direction of the front cover 46 towards the front side (or in the outward direction of the curve), as shown in FIG. 8.

The guide surface of the carrying guide 48 according to the present embodiment is formed by the sheet guide surface 48*a* in the center part and sheet guide ribs positioned on both sides of the center part in the width direction.

Such a front cover 46 is attached on the front side of the sheet carrying unit 37 with the first pressure application roller 12 being accommodated in the accommodation space 49 so that the carrying path of the sheet carrying device 50 shown in FIG. 9 is formed.

In FIG. 9, reference numeral 51 indicates a first sheet supply carrying path formed between sheet guide ribs provided on the back side of the sheet carrying guide 39, which is attached on the front side of the unit main body 38 of the sheet carrying unit 37, and sheet guide ribs provided at the sheet carrying guide part 40 formed on the unit main body 38. The sheet supply carrying path 51 directs the sheet P fed from the sheet cassette 2 by the sheet supply roller 9 and the retard roller 10 to the first carrying roller pair 13.

Moreover, a second sheet carrying path 26 is formed between the sheet guide ribs provided on the front side of the sheet carrying guide 39 and the carrying guide 47 formed by the sheet guide ribs formed at the front cover 46 facing the sheet carrying guide 39. The second sheet carrying path 26 directs the sheet P fed from the sheet cassette 4 of each tray 5 to the first carrying roller pair 13.

Reference numeral 52 indicates a third sheet carrying path, or turning path, which connects the first carrying roller pair 13 formed by the first drive roller 11 and the first pressure application roller 12, which face each other in an approximately horizontal direction, and the second carrying roller pair 17 formed by the second drive roller 15 and the second pressure application roller 16, which face other in an approximately vertical direction. The turning path 52 has a predetermined radius of curvature. The turning path 52 is a carrying path that bends the carrying direction of sheet P carried from the first drive roller 11 by approximately 90 degrees, from the vertical direction to the horizontal direction, and directs the sheet P to the second carrying roller pair 17.

In the embodiment shown in FIG. 9, the carrying direction of sheet P by the first drive roller 11 is referred as a first sheet carrying direction. The other carrying direction of sheet P by the second drive roller 15 is referred as a second sheet carrying direction.

The turning path 52 is formed by positioning a pair of carrying guides 48 and 53 to face each other. The carrying guide 53 is formed by a plurality of curved sheet guide ribs formed on the downstream side of the first carrying roller pair 13 on the front side (side of the front cover 46) of the unit main body 38 that is positioned on an inner side of the curve (see FIG. 3). The carrying guide 48 is formed by the curved sheet guide ribs and the like of the front cover 46 positioned on an outer side of the curve.

The first carrying roller pair 13 is positioned at a connection part of the sheet supply carrying path 51 and the turning carrying path 52 of the present embodiment. A sheet guide 55 that directs the sheet P carried from the first carrying roller pair 13 to the carrying guide 48 of the front cover 46 is provided at the groove 12*c* (shaded parts in FIG. 9 and the like) of the first pressure application roller 12 positioned on the outer side in the curve.

Figure 10:
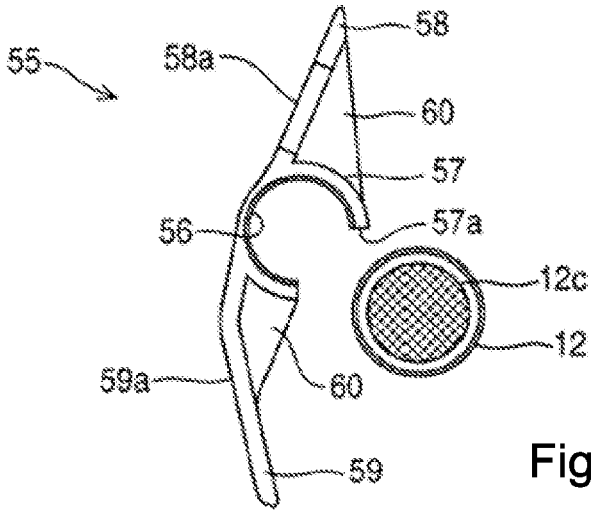
FIG. 10 is an explanatory diagram showing a side surface of the sheet guide according to the first embodiment.

As shown in FIG. 10, the sheet guide 55 includes a support part 57 with a C-shaped cross-section, a guide part 58 and a weight 59. The support part 57 includes an inner diameter forming an engagement hole 56 that freely fits onto a root diameter of the groove 12*c* of the first pressure application roller 12 and an outer diameter forming a cylindrical member that has the same diameter as the diameter of a circumferential surface of the first pressure application roller 12. In addition, the support part 57 includes an opening 57*a* formed to open in the axial direction on a cylindrical wall on a side opposite from the first drive roller 11. On the guide part 58, a guide surface 58*a* is formed that extends from the outer diameter of the first pressure application roller 12 in a tangential direction and is connected to the circumferential surface of the support part 57 by an R curvature. The weight 59 is formed on a side opposite from the guide part 58 across the support part 57. The first pressure application roller 12 is attached by pressing and fitting the opening onto the root diameter of the groove 12*c* of the first pressure application roller 12 (see FIG. 9).

By this, the engagement hole 56 of the sheet guide 55 fits on the root diameter of the groove 12*c* of the first pressure application roller 12. Because the first pressure application roller 12 and the sheet guide 55 have a small friction coefficient with each other (e.g., metal and plastic), the sheet guide 55 is supported freely rotatably by the first pressure application roller 12 so that, as shown in FIG. 9, when the end on the downstream side in the sheet carrying direction, that is, the top end, of the guide part 58 contacts the positioning part 48*b* provided on the carrying guide 48, the guide surface 58*a* that smoothly extends from the circumferential surface of the support part 57 smoothly connects the nip of the first carrying roller pair 13 and the carrying guide 48 on the outer side of the curve of the turning carrying path 52.

Moreover, the guide part 58 and the weight 59 are reinforced by ribs 60 that are respectively connected to the support part 57, and the guide part 58 becomes narrower towards the top end (see FIG. 4). The weight 59 formed in a rectangular shape has more weight than the guide part 58 and is formed so that the center of gravity of the sheet guide 55 is positioned on the side of the weight 59.

As a result, unless an external force is applied to the sheet guide 55, the weight 59 maintains the orientation of the sheet guide 55 by rotating the guide part 58 to a predetermined position.

Further, the weight 59 functions as a second guide part that includes a guide surface 59*a* (the surface on the side of the sheet carrying guide 39) that directs the front end of the sheet P carried from the tray 5 positioned therebeneath through the additional sheet carrying path 26 to the nip of the first carrying roller pair 13.

A sheet carrying operation from the sheet cassette 2 to the image forming unit 21 according to the present embodiment is explained below.

When the user inputs information of a print material to the printer 1, the pickup roller 8 and the sheet supply roller 9 are driven by a drive force from an undepicted drive source. The sheets P stacked on the placement plate 2*a* of the sheet cassette 2 are separated to each sheet by the frictional force of the retard roller 10 and are fed to the sheet supply carrying path 51 (see FIG. 2).

The front end of the sheet P fed to the sheet supply carrying path 51 is carried along the sheet carrying guide 39 to the nip of the first carrying roller pair 13 formed by the first drive roller 11 that is rotated by the drive force from the undepicted drive source and the first pressure application roller 12 that is driven and rotated by the frictional force between the rollers. The front end of the sheet P that is nipped by the first carrying roller pair 13 enters the turning carrying path 52 from the nip and contacts the guide part 58 of the sheet guide 55 (see FIG. 9).

At this time, the sheet guide 55 attached to the first pressure application roller 12 tends to rotate in the carrying direction (the clockwise direction in FIG. 9) about the root diameter of the groove 12. However, the rotation of the sheet guide 55 is restricted as the guide part 58 of the sheet guide 55 contacts the positioning part 48*b* provided on the front cover 46, and the guide part 58 overlaps onto the carrying guide 48 of the front cover 46. Therefore, the nip of the first carrying roller pair 13 and the carrying guide 48 are connected smoothly.

The front end of the sheet P carried by the first carrying roller pair 13 is directed to the carrying guide 48 of the turning carrying path 52 along the guide part 58 of the sheet guide 55 and towards the nip of the second carrying roller pair 17 formed by the second drive roller 15 and the second pressure application roller 16 along the carrying guide 48. When the front end is detected by the entrance sensor 14, the second drive roller 15 and the second pressure application roller 16 are rotated by the drive force from the undepicted drive source and carry the sheet P to the image forming unit 21.

In this case, when the front end of the sheet P is nipped by the second carrying roller pair 17, the driving of the first drive roller 11 of the first carrying roller pair 13 stops, and the sheet P is carried by the second carrying roller pair 17 while being nipped by the freely rotating first drive roller 11 and the first pressure application roller 12. When the rear end of the sheet P is released from the nip of the first carrying roller pair 13, the rear end of the sheet is carried to the carrying guide 48 of the turning carrying path 52 along the guide surface 58*a* of the guide part 58 of the sheet guide 55. In addition, side edges of the rear end of the sheet in the lateral direction are carried on the side of the carrying guide 48 of the front cover 46, both ends of which are contoured (curved) towards the front side, as shown in FIGS. 8 and 15.

Figure 11:
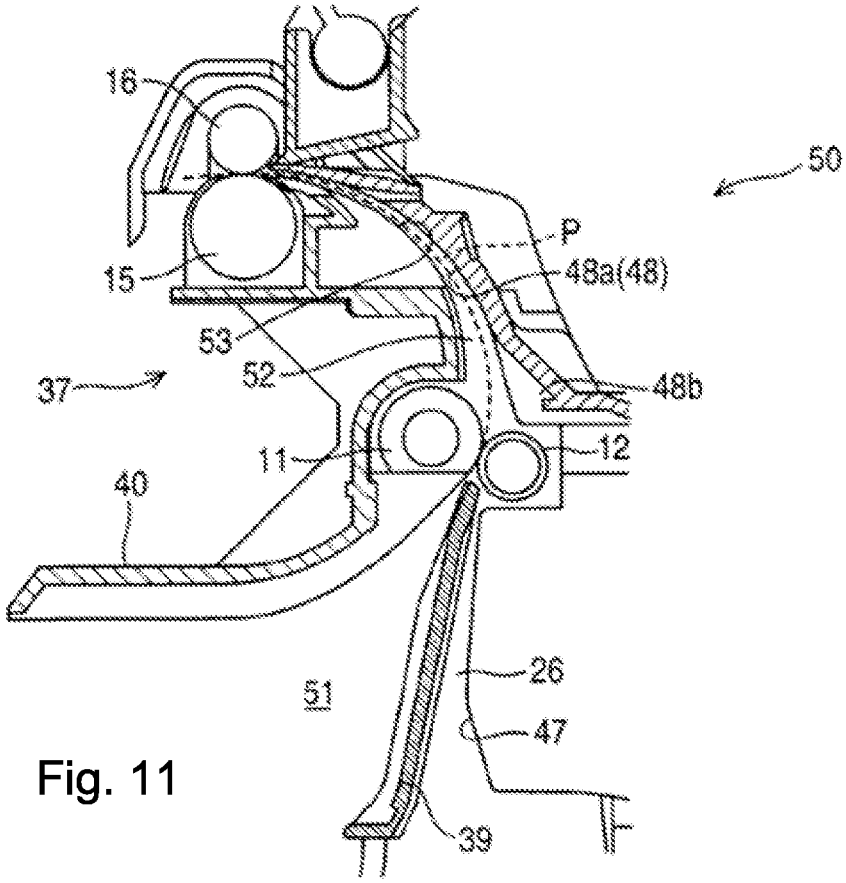
FIG. 11 is an explanatory diagram showing effects without the sheet guide of the first embodiment.

At this time, as shown in FIG. 11, if the sheet guide 55 is not attached to the first pressure application roller 12, the rear end of the sheet P swiftly moves in the direction of the carrying guide 48 and strikes the carrying guide 48 of the turning carrying path 52 due to the restorative force of the rear end of the sheet at the moment the rear end of the sheet is released from the first carrying roller pair 13. However, according to the present embodiment, the sheet guide 55 is attached to the first pressure application roller 12, and the carrying guide 48 of the front cover 46 is overlapped on the guide part 58 of the sheet guide 55. In addition, the nip of the first carrying roller pair 13 and the carrying guide 48 are smoothly connected. Therefore, the force by the rear end of the sheet caused by the restorative force of the sheet P that is generated at the moment when the rear end is released from being nipped by the first carrying roller pair 13 is received by the guide part 58 of the sheet guide 55. As a result, the sheet P can be smoothly carried to the carrying guide 48 of the front cover 46, and the hitting sound between the rear end of the sheet and the carrying guide 48 is suppressed.

Furthermore, two sheet guides 55 are attached to the center part of the first pressure application roller 12, and the heights of the sheet guide ribs of the carrying guide 48 are reduced gradually from the center part to the edge part in the width direction. Therefore, even if the rear end of the sheet P is flipped by the restorative force, the sheet P can be carried without causing the rear end to hit the carrying guide 48 at the edge side of the sheet in the width direction. Therefore, the hitting sound caused by the flipping movement by the rear end of the sheet P is reduced.

On the other hand, the front end of the sheet P carried upwardly from the sheet cassette 4 of the tray 5 through the additional sheet carrying path 26 enters between the guide surface 59*a* of the weight 59 of the sheet guide 55 and the sheet carrying guide 39 as directed by the sheet guide ribs provided on the front side of the sheet carrying guide 39 and the carrying guide 47 of the front cover 46 facing the sheet carrying guide 39. Then, the sheet P is carried to the nip of the first carrying roller pair 13 along the guide surface 59*a*. The front end of the sheet P nipped by the first carrying roller pair 13 enters the turning carrying path 52 from the nip and contacts the guide part 58 of the sheet guide 55 (see FIG. 9).

The subsequent operation for carrying the sheet is the same as that described above, and thus, the explanation is omitted.

As explained above, according to the present embodiment, a pair of rollers is positioned to face each other. A turning carrying path formed by a pair of carrying guides that turn the sheet carrying direction by a predetermined curvature radius and to a direction approximately perpendicular to the facing direction of a first carrying roller pair that carries the sheet by nipping the sheet between the pair of rollers is positioned at the downstream side of the first carrying roller pair in the sheet carrying direction. By providing a sheet guide that has a support part, which is supported to freely rotate by a roller positioned on the outer side of the curve of the turning carrying path of the first carrying roller pair, and by providing, at the support part of the sheet guide, a guide part that connects the nip of the first carrying roller pair and the carrying guide on the outer side of the curve of the turning carrying path, the flapping motion by the rear end of the sheet P due to the restorative force that is generated at the moment when the rear end is released from being nipped by the first carrying roller pair can be suppressed by the guide part of the sheet guide. Therefore, there is an effect to reduce the hitting sound caused by the rear end of the sheet at the time of sheet supply.

Furthermore, the sheet guide is provided at the center part in the width direction, and the guide surface of the carrying guide on the outer side of the curve contours from the center part to the both sides in the width direction towards the front side, respectively. Therefore, even if the rear end of the sheet P moves in a flapping manner due to the restorative force, the sheet P can be carried without causing the rear end to hit the carrying guide in the width direction of the sheet P. As such, there is an effect that the hitting sound caused by the flapping motion of the rear end of the sheet P can be further reduced.

(Second Embodiment)

Figure 12:
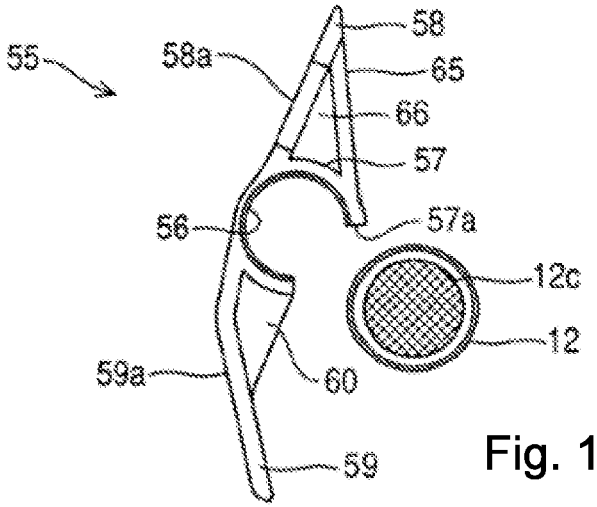
FIG. 12 is an explanatory diagram showing the side surface of the sheet guide according to the second embodiment.

Below, the sheet guide according to the present embodiment is explained with reference to FIGS. 12 and 13. Parts that are the same as those in the above-discussed first embodiment are identified by the same reference numerals, and their descriptions are omitted As shown in FIG. 12, the sheet guide 55 of the present embodiment is provided with a column 65 that connects the vicinity of the opening 57*a* of the support part 57 and the edge part on the downstream side, that is, the top edge, of the guide part 58. A space 66 is formed between the guide part 58 and the column 65.

The sheet carrying operation from the sheet cassette 2 to the image forming unit 21 according to the second embodiment is explained below.

In the sheet carrying operation according to the second embodiment, the operation in which the front end of the sheet P, which is fed from the sheet cassette 2 to the sheet supply carrying path 51 and nipped by the first carrying roller pair 13, contacts the guide part 58 of the sheet guide 55 and in which the guide part 58 smoothly contacts the nip of the first carrying roller pair 13 and the carrying guide 48 is the same as that of the first embodiment. Therefore, a description of this operation is omitted.

As in the first embodiment, the front end of the sheet P carried by the first carrying roller pair 13 is directed to the carrying guide 48 of the turning carrying path 52 along the guide part 58 of the sheet guide 55 and carried towards the nip of the second carrying roller pair 17 along the carrying guide 48. When the front end is detected by the entrance sensor 14, the second drive roller 15 and the second pressure application roller 16 rotate to carry the sheet P to the image forming unit 21.

In this case, when the front end of the sheet P is nipped by the second carrying roller pair 17, driving of the first drive roller 11 of the first carrying roller pair 13 is stopped, and the sheet P is nipped and carried by the second carrying roller pair 17 while being nipped by the nip of the freely rotating first drive roller 11 and the first pressure application roller 12. When the rear end of the sheet P is released from the nip of the first carrying roller pair 13, the rear end is carried to the carrying guide 48 of the front cover 41 along the guide surface 58*a* of the guide part 58.

Figure 13:
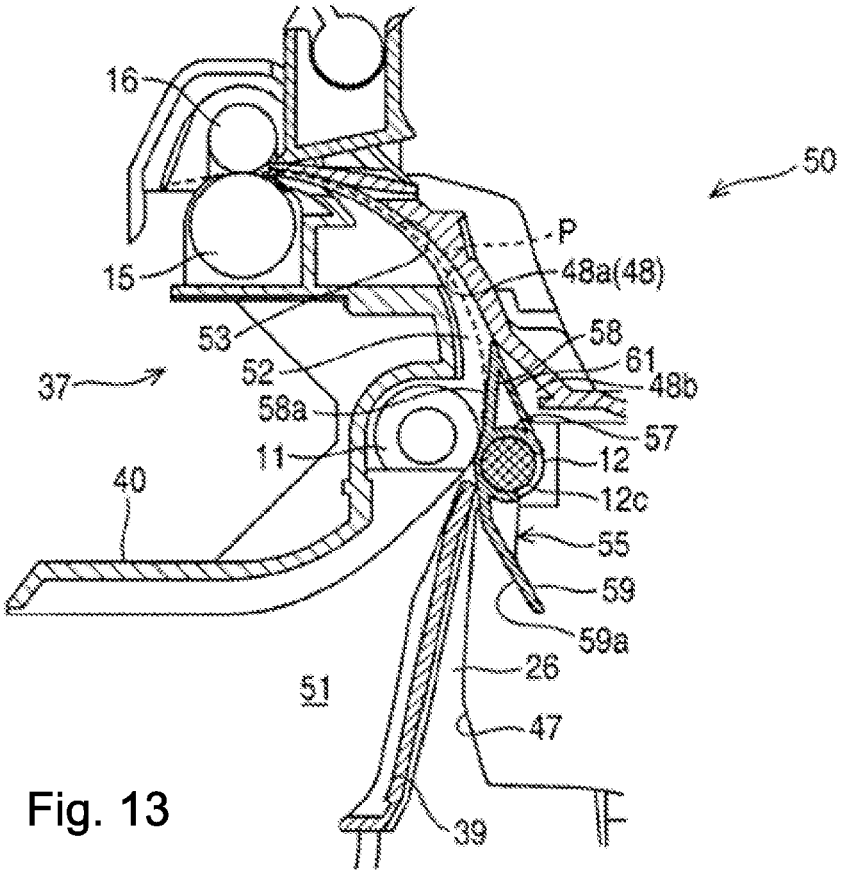
FIG. 13 is an explanatory diagram showing a configuration of the sheet carrying device according to the second embodiment.
Figure 14:
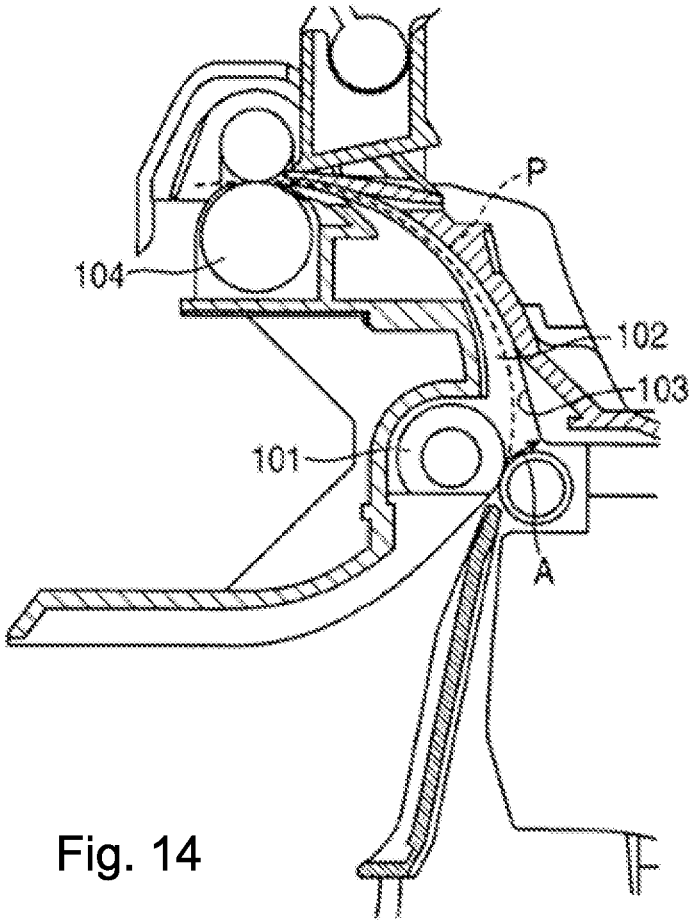
FIG. 14 is an explanatory diagram showing a configuration of the conventional sheet carrying device.

According to the second embodiment, as shown in FIG. 13, because the space 66 is provided between the guide part 58 and the column 65 of the sheet guide 55 attached to the first pressure application roller 12, when the flapping motion of the rear end of the sheet P due to the restorative force, which is generated at the moment when the rear end is released from the first carrying roller pair 13, is received by the guide part 58 of the sheet guide 55, the guide part 58 is bent in a direction towards the space 66 and absorbs energy of the collision between the rear end of the sheet P and the guide part 58.

Thereafter, the rear end of the sheet P is carried from the guide part 58 through the turning carrying path 52 along the carrying guide 48 of the front cover 46, and the guide part 58 returns to its original shape.

The case of the sheet P being carried from a lower direction from the sheet cassette 4 of the tray 5 through the additional sheet carrying path 26 is the same as that described above.

As explained above, according to the present embodiment, in addition to the effect of the first embodiment, there is also an effect to further reduce the hitting sound caused by the rear end of the sheet during the sheet supply by providing, at the sheet guide, a column that connects the support part that fits on the roller on the outer side of the curve and the edge part of the guide part on the downstream side of the sheet carrying direction to create a space between the guide part and the column. As a result, the force of the rear end of the sheet bends the guide part of the sheet guide to absorb energy at the moment when the rear end is released from being nipped by the first carrying roller.

In the above-discussed embodiments, a case in which two sheet guides are attached to the first pressure application roller of the first carrying roller pair of the sheet carrying device provided in the image forming device is discussed as an example. However, similar effects can be obtained in a configuration in which two or more sheet guides are attached to another roller.

What is claimed is:

1. A sheet guide that is rotationally supported by a shaft member to rotate freely on the shaft member, wherein the sheet guide comprises:

a support part that supports the sheet guide on the shaft member;

a guide part that contacts and guides sheets in a predetermined direction; and a weight that is arranged on an opposite side of the support part from the guide part, wherein the weight causes the guide part to rotate to a predetermined position when an external force applied to the guide part is released, wherein the support part is provided between the guide part and the weight along a sheet carrying direction, and the weight includes a first medium carrying path guide part configured to receive a sheet from a first medium carrying path, and a second medium carrying path guide part configured to receive a sheet from a second medium carrying path different from the first medium carrying path.

2. The sheet guide according to claim 1, wherein the weight includes a second medium carrying path guide part that guides sheets that are supplied from a location below the shaft member.

3. The sheet guide according to claim 1, wherein the sheet guide forms part of a sheet carrying device.

4. The sheet guide according to claim 3, wherein the sheet carrying device forms part of an image forming device.

5. The sheet guide according to claim 1, wherein the shaft member also supports a roller of a pair of nip rollers.

6. The sheet guide according to claim 5, wherein two sheet paths lead to the pair of nip rollers from different upstream directions, and one sheet path leads away from the pair of nip rollers in a downstream direction.

7. The sheet guide according to claim 1, wherein the sheet guide is located at an upstream end of a sheet turning path, which changes a direction of sheet travel by approximately ninety degrees.

8. The sheet guide according to claim 7, wherein the sheet turning path is defined at least in part by a curved carrying guide, and the sheet guide is constructed and arranged to receive a rear end of a sheet that is released by a pair of rollers and to guide the rear end to a carrying guide.

9. The sheet guide according to claim 1, wherein the weight is provided on an upstream side of the support part in the sheet carrying direction.

10. The sheet guide according to claim 1, wherein the support part includes an opening on a circumference of the support part, through which the shaft member extends.

11. The sheet guide according to claim 1, wherein the first medium carrying path guide part is angled from the second medium carrying path guide part.

12. A sheet carrying device, comprising:

a carrying roller pair that carries sheets by rotation;

a sheet guide that is freely rotational and that is provided on one roller of the carrying roller pair, wherein the sheet guide includes a guide part that contacts the sheets and guides the sheets in a predetermined direction, and a guide surface that extends in a tangential direction of an outer surface of the one roller when viewed in an axial direction of a rotational shaft of the one roller, wherein the guide surface is provided tangentially to an outer surface of the one roller when viewed in an axial direction of a rotational shaft of the one roller.

13. The sheet carrying device according to claim 12, wherein the sheet carrying device forms part of an image forming device.

14. A sheet carrying device, comprising:

a carrying roller pair, in which rollers of the pair face each other, wherein the carrying roller pair nips sheets, and wherein the sheets are carried between the rollers in a first sheet carrying direction;

a turning path on a downstream side of the carrying roller pair in the first sheet carrying direction, wherein the turning path is formed by a pair of carrying guides, and wherein the turning path changes a direction of sheet travel from the first sheet carrying direction by a predetermined curve to a second sheet carrying direction that is approximately perpendicular to the first sheet carrying direction;

a sheet guide, which includes a support part that is supported by one of the carrying roller pair in a freely rotational manner, wherein the sheet guide is positioned on an outer side of the curve of the turning path; and a guide part, which is provided at the support part of the sheet guide, wherein the guide part connects a nip of the carrying roller pair and one of the carrying guides that is located on the outer side of the curve of the turning path, wherein the sheet guide is provided separately from the turning path.

15. The sheet carrying device according to claim 14, further comprising a weight, wherein the weight places a center of gravity of the sheet guide on a side of the support part that is opposite to the guide part.

16. The sheet carrying device according to claim 15, further comprising:

a first sheet carrying path that is provided on an upstream side of the carrying roller pair and that carries sheets to the carrying roller pair; and a second sheet carrying path that is generally parallel with the first sheet carrying path and that carries sheets from a location below the sheet guide to the carrying roller pair, wherein the weight is provided with a guide surface that directs sheets carried in the second sheet carrying path to the nip of the carrying roller pair.

17. The sheet carrying device according to claim 14, further comprising:

a column that connects the support part and an edge part of the guide part on the downstream side in the sheet carrying direction and that is positioned in the sheet guide, wherein a space is created between the guide part and the column.

18. The sheet carrying device according to claim 14, wherein the sheet guide is provided at a center part of the one of the carrying roller pair in a width direction, which is perpendicular to the first sheet carrying direction, and a guide surface of the outer side carrying guide is contoured from the center part to lateral sides in an outward direction of the curve of the sheet carrying device.

19. The sheet carrying device according to claim 14, wherein the sheet carrying device forms part of an image forming device.

20. A sheet guide that is rotationally supported by a shaft member to rotate freely on the shaft member, wherein the sheet guide comprises:

a support part that supports the sheet guide on the shaft member;

a guide part that contacts and guides sheets in a predetermined direction; and a weight that is arranged on an opposite side of the support part from the guide part, wherein the weight causes the guide part to rotate to a predetermined position when an external force applied to the guide part is released, wherein the support part is provided between the guide part and the weight along a sheet carrying direction, the shaft member also supports a roller of a pair of nip rollers, and two sheet paths lead to the pair of nip rollers from different upstream directions, and one sheet path leads away from the pair of nip rollers in a downstream direction.

* * * * *